US010087788B2

(12) United States Patent
Sasaki et al.

(10) Patent No.: US 10,087,788 B2
(45) Date of Patent: Oct. 2, 2018

(54) LIFTER ROTATION PREVENTING STRUCTURE

(71) Applicant: OTICS CORPORATION, Nishio-shi, Aichi (JP)

(72) Inventors: Tatsuya Sasaki, Nishio (JP); Daiki Miyazawa, Nishio (JP); Kimihiko Todo, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 223 days.

(21) Appl. No.: 15/091,878

(22) Filed: Apr. 6, 2016

(65) Prior Publication Data

US 2016/0298501 A1 Oct. 13, 2016

(30) Foreign Application Priority Data

Apr. 10, 2015 (JP) ..... 2015-080658

(51) Int. Cl.
*F01L 1/14* (2006.01)
*F02M 59/10* (2006.01)
(Continued)

(52) U.S. Cl.
CPC ..... *F01L 1/14* (2013.01); *F01L 1/143* (2013.01); *F01L 1/462* (2013.01); *F01L 3/10* (2013.01);
(Continued)

(58) Field of Classification Search
CPC ..... F01L 1/14; F01L 2105/00; F01L 2107/00; F01L 2003/11; F02M 59/102
(Continued)

(56) References Cited

U.S. PATENT DOCUMENTS 8,607,754 B2 * 12/2013 Dorn ..... F01L 1/146 123/90.48
2011/0116945 A1 5/2011 Shibata
(Continued)

FOREIGN PATENT DOCUMENTS

DE 102010022319 A1 12/2011
EP 2853699 A1 4/2015
(Continued)

OTHER PUBLICATIONS

Extended European Search Report dated Aug. 25, 2016 in European Patent Application No. 16 000 652.4 (6 pages).
(Continued)

*Primary Examiner* — Ching Chang
(74) *Attorney, Agent, or Firm* — Smith, Gambrell & Russell, LLP

(57) ABSTRACT

A lifter rotation preventing structure includes a lifter body, a retainer and a biasing member. The lifter body is inserted into a sliding hole of a housing and reciprocated according to rotation of a cam. The lifter body has a peripheral wall slidable in a sliding hole and a partition wall partitioning an inside of the peripheral wall into a first space where the cam is located and a second space located opposite the first space. The retainer has a retainer body connected to an engaging member and a rotation preventing protrusion protruding from an outer periphery of the retainer body and fittingly extending through the peripheral wall. The rotation preventing protrusion has a distal end moved into a rotation preventing groove to prevent the lifter body from rotation. The biasing member interposed between the retainer body and the housing to bias the lifter body to the cam side.

5 Claims, 4 Drawing Sheets

(51) Int. Cl.
*F01L 1/46* (2006.01)
*F01L 3/10* (2006.01)
*F01L 3/00* (2006.01)

(52) U.S. Cl.
CPC ..... *F02M 59/102* (2013.01); *F01L 1/146* (2013.01); *F01L 2003/11* (2013.01); *F01L 2105/00* (2013.01); *F01L 2107/00* (2013.01)

(58) Field of Classification Search
USPC ..... 123/90.48, 90.5
See application file for complete search history.

(56) References Cited

U.S. PATENT DOCUMENTS

2013/0068064 A1 3/2013 Geyer et al.
2014/0150602 A1 6/2014 Hauvespre et al.

FOREIGN PATENT DOCUMENTS

| | | | |
|---|---|---|---|
| FR | 1133730 | A | 4/1957 |
| JP | S62-179303 | U | 11/1987 |
| JP | H03-294653 | A | 12/1991 |
| JP | H05-075403 | U | 10/1993 |
| JP | 2010-001884 | A | 1/2010 |
| JP | 2010-511834 | A | 4/2010 |

OTHER PUBLICATIONS

Japanese Office Action dated Jun. 26, 2018 in Japanese Patent Application No. 2015-080658 (3 pages in Japanese with English translation).

* cited by examiner

LIFTER ROTATION PREVENTING STRUCTURE

CROSS-REFERENCE TO RELATED APPLICATIONS

This application is based upon and claims the benefit of priority from the prior Japanese Patent Application No. 2015-80658 filed on Apr. 10, 2015, the entire contents of which are incorporated herein by reference.

BACKGROUND

1. Technical Field

The present invention relates to a lifter rotation preventing structure.

2. Related Art

Japanese Patent Application Publication No. JP-A-2010-1884 discloses a sliding lifter which is reciprocably inserted into a sliding hole of a cylinder head. The sliding lifter includes a cylindrical body slidable in the sliding hole and an abutting portion connected to an inner periphery of the body. The body is formed with a pair of supports opposed to each other. A shaft has two ends fixed to the respective supports. A roller which is brought into sliding contact with a cam is rotatably supported on the shaft.

The abutting portion divides an interior of the body into a space at the side where the cam and the roller are located and another space located at the opposite side. An engaging member comprising a valve stem (in the case of a valve lifter) or a plunger (in the case of a pump lifter) is disposed in the space located at the aforementioned opposite side.

The engaging member is reciprocally moved according to the lifter reciprocated with rotation of the cam to open/close a valve or to pressure-feed fuel. The engaging member has an outer periphery to which a retainer is fixed. A coil spring is interposed between the retainer and a cylinder head to bias the lifter to the cam side.

The lifter body has an axial end having a part in which the supports are not formed. A rotation preventing protrusion is formed on the part of the axial end of the lifer body. The rotation preventing protrusion is inserted into a rotation preventing groove communicating with the sliding hole of the cylinder head, thereby preventing the lifter from rotation.

In the above-described conventional lifter, the rotation preventing protrusion is formed on the axial end of the body in consideration of workability and the like. Accordingly, there is a problem that an overall length of the body (a sliding length) would be limited by a position of the rotation preventing protrusion. For example, when the size of the lifter is reduced and a sufficient overall length of the body is not ensured, there is a possibility that the body would be tilted beyond an allowable range within a range of clearance in the sliding hole (cocking). Further, since the cylindrical shape of the body is impaired by the rotation preventing protrusion, a finish processing in which the body is fed in one direction in a through-feed manner is hard to carry out when an outer periphery of the body is ground, for example.

SUMMARY

Therefore, an object of the invention is to provide a lifter rotation preventing structure which can ensure a sufficient sliding length and can provide easy execution of the finish processing.

The invention provides a lifter rotation preventing structure including a lifter body, a retainer and a biasing member.

The lifter body is inserted into a sliding hole of a housing and reciprocated according to rotation of a cam. The lifter body has a peripheral wall slidable in the sliding hole and a partition wall partitioning an inside of the peripheral wall into a first space in which the cam is located and a second space located opposite the first space. The retainer is disposed in the second space of the lifter body and has a retainer body located inside the peripheral wall and connected to an engaging member reciprocally displaced together with the lifter body. The retainer has a rotation preventing protrusion protruding from an outer periphery of the retainer body and fittingly extending through the peripheral wall. The rotation preventing protrusion has a distal end moved into a rotation preventing groove communicating with the sliding hole of the housing thereby to prevent the lifter body from rotation. The biasing member is disposed in the second space of the lifter body and interposed between the retainer body and the housing to bias the lifter body to the cam side.

According to the above-described construction, the lifter body can be prevented from rotation by the rotation preventing protrusion moved into the rotation preventing groove. In this case, the retainer has the rotation preventing protrusion. Accordingly, the rotation preventing protrusion is not an obstacle when an entire length of the peripheral wall (the dimension in a sliding direction) is set, with the result that the freedom in adjusting the length of the peripheral wall is improved. This differs from the case where the rotation preventing protrusion is provided on an end of the peripheral wall or the like. Consequently, the entire length of the peripheral wall can be rendered as long as possible, whereby the peripheral wall can be prevented from being tilted in the sliding hole beyond an allowable range.

Furthermore, the retainer has the rotation preventing protrusion. This can eliminate a part protruding from the outer periphery of the peripheral wall radially outward. As a result, the outer periphery of the peripheral wall can be ground in the through-feed manner thereby to be finished easily. Further, the above-described structure can reduce the number of parts as compared with the case where a dedicated rotation preventing member (a wedge-shaped member) is inserted into the peripheral wall, thereby keeping production costs down.

The invention is applicable to a pump lifter of a fuel supply system when the engaging member is a plunger movable into and out of a pressure chamber of the housing or the like. Further, the invention is applicable to a valve lifter of a valve gear when the engaging member is a valve capable of opening and closing an air inlet or air outlet of the housing.

DETAILED DESCRIPTION

First Embodiment

Figure 1:
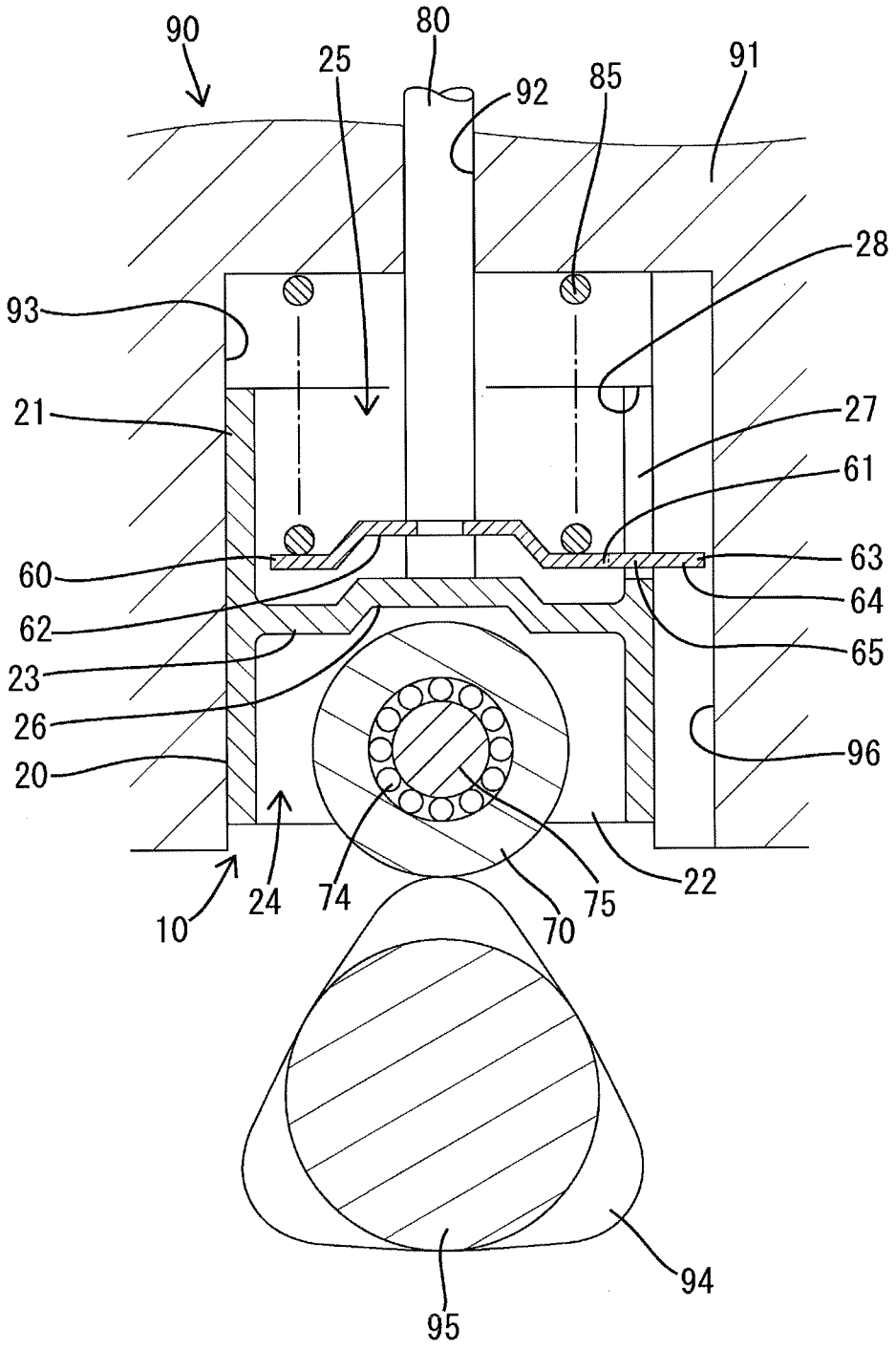
FIG. 1 is a sectional view of a pump lifter to which the lifter rotation preventing structure of a first embodiment is applied, showing the pump lifter assembled to a housing.

A first embodiment will be described with reference to FIGS. 1 to 3. In the first embodiment, the lifter rotation preventing structure is applied to a pump lifter 10 provided in a fuel supply system 90 of an automobile. A retainer 60 is disposed in a cylindrical lifter body 20. Both the lifter body 20 and the retainer 60 are forgings.

The fuel supply system 90 supplies fuel high pressurized by the pump lifter 10 into a combustion chamber of an engine (not shown) although not shown in detail. The pump lifter 10 is incorporated into a housing 91 forming a cylinder head.

The housing 91 has a through hole 92 vertically extending therethrough and having a circular cross section as shown in FIG. 1. A plunger 80 serving as an engaging member is inserted into the through hole 92 so as to be reciprocally slidable. The plunger 80 is formed into the shape of a column elongated vertically. The plunger 80 has an upper end which is disposed to be movable into and out of a pressure chamber (not shown) of the housing 91, which pressure chamber communicates with an upper end of the through hole 92. Pressure is applied to the fuel in the pressure chamber when the upper end of the plunger 80 is moved into the pressure chamber.

The housing 91 is also formed with a sliding hole 93 communicating with a lower end of the through hole 92. The sliding hole 93 is concentric with the through hole 92 and has a circular cross section with a larger diameter than the through hole 92. The sliding hole 93 is formed to extend vertically. The lifter body 20 is inserted into the sliding hole 93 so as to be reciprocable vertically (in a sliding direction).

The lifter body 20 has a substantially cylindrical peripheral wall 21 extending along the vertical direction. The peripheral wall 21 includes an outer periphery disposed along an inner periphery of the sliding hole 93 so as to be slidable in the sliding hole 93. The peripheral wall 21 has a lower edge which is continuous at a substantially uniform height position over an entire circumference and extended as downward as possible within a range outside a movement range of a cam 94 which will be described later.

Figure 3:
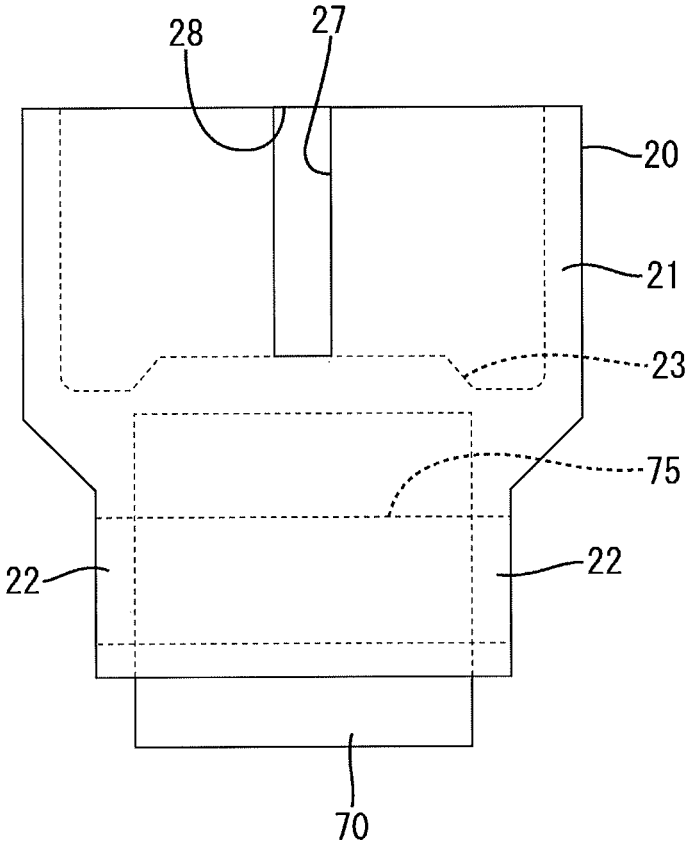
FIG. 3 is a side elevation of the lifter body.

The peripheral wall 21 has a lower end further having both radial ends (right and left ends in FIG. 3) on which a pair of support walls 22 are mounted to be opposed substantially in parallel to each other, respectively, as shown in FIG. 3. A shaft 75 has two ends supported on the support walls 22 respectively. A cylindrical roller 70 is rotatably supported on the shaft 75 via a bearing 74 such as a needle bearing.

The roller 70 is disposed so that an outer periphery thereof is brought into sliding contact with a cam 94 provided below the housing 91. The cam 94 has a substantially triangular shape and is mounted on a cam shaft 95. The cam shaft 95 is disposed so that an axis line thereof is parallel to an axis line of the shaft 75.

The lifter body 20 has a generally flat plate-shaped partition wall 23 extending along a radial direction (a direction perpendicular to the vertical direction) inside the peripheral wall 21, as shown in FIG. 1. The partition wall 23 is formed integrally with the peripheral wall 20 such that an outer periphery of the partition wall 23 is connected to a vertically middle part of the inner periphery of the peripheral wall 21. The lifter body 20 is partitioned into an upper part and a lower part by the partition wall 23. The lower part open below the partition wall 23 is defined as a cam side space (first space) at the side where the cam 94 is located. The upper part open above the partition wall 23 is defined as an engaging member side space (second space) 25 at the side where the plunger 80 serving as an engaging member is located.

The cam side space 24 of the lifter body 20 includes two radial ends partitioned by two support walls 22 thereby to serve as a space for housing the roller 70 disposed between the support walls 22. A stepped portion 26 is formed on a radial middle of the partition wall 23 and bulges upward so as to escape from a top of the roller 70 housed in the cam side space 24. The stepped portion 26 has an upper surface that is a flat surface facing the engaging member side space 25. The plunger 80 has a lower end abutting against the flat surface.

The engaging member side space 25 of the lifter body 20 houses the lower end of the plunger 80, a retainer 60 and a biasing member 85 inside the cylindrical peripheral wall 21. The retainer 60 has a substantially uniform thickness over an entire part thereof. The thickness of the retainer 60 is smaller than a thickness of the lifter body 20 (the partition wall 23 and the peripheral wall 21). The retainer 60 has a disc-shaped retainer body 61 formed into a flat plate shape extending along the radial direction, as shown in FIG. 2. The retainer body 61 has a radial middle formed with an annular protrusion 62 bulging upward as shown in FIG. 1. The annular protrusion 62 is disposed substantially in parallel to the stepped portion 26. The lower end of the plunger 80 extends through a central portion of the annular protrusion 62 to be locked, whereby the retainer 60 is connected and fixed to the plunger 80 with the result that the plunger 80 is retained in an upright position.

The biasing member 85 is a spring member comprising a compression coil spring. As shown in FIG. 1, the biasing member 85 has a lower end which abuts against an upper surface of an outer periphery (a radially outer part of the annular protrusion 62) of the retainer body 61 thereby to be supported, and an upper end which abuts against a wall surface of the housing 91 thereby to be supported, whereby the biasing member 85 is elastically extensible/contractible vertically. Consequently, the biasing member 85 biases the lifter body 20 to the cam 94 side. Thus, the biasing member 85 has a biasing force that presses the roller 70 against the cam 94.

Figure 2:
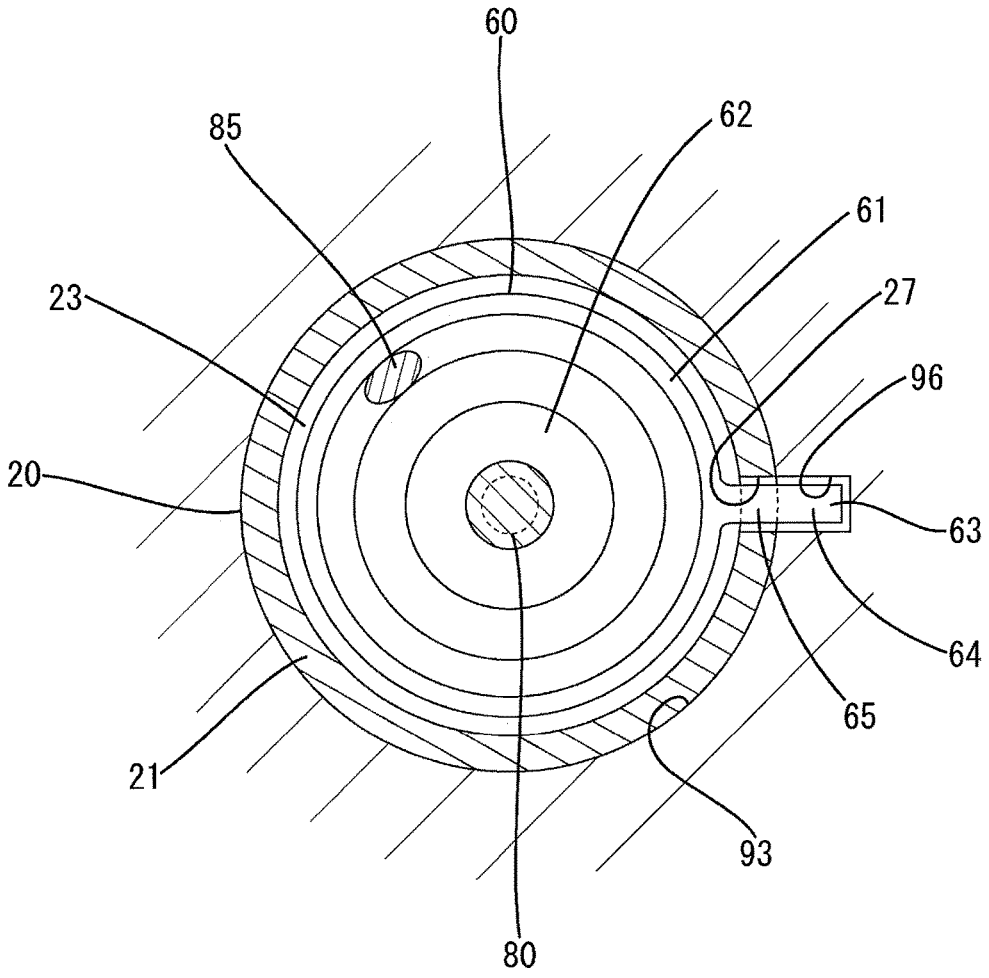
FIG. 2 is a sectional view of the pump lifter as viewed from above.

The retainer 60 is provided with a plate-shaped rotation preventing protrusion 63 which protrudes radially outward from the outer periphery of the retainer body 61, as shown in FIG. 2. The rotation preventing protrusion 63 fittingly extends through the peripheral wall 21 of the lifter body 20 in the radial direction and has a distal end 64 protruding radially outward with respect to the lifter body 20.

The housing 91 is provided with a rotation preventing groove 96 which communicates with the sliding hole 93 and extends vertically as shown in FIG. 1. The distal end 64 of the rotation preventing protrusion 63 is adapted to be fittingly moved into the rotation preventing groove 64. Further, as shown in FIG. 3, the peripheral wall 21 includes an upper part formed with a slit-like insertion hole 27 which extends vertically and opens at an upper end of the peripheral wall 21. The insertion hole 27 includes a lower end which is closed above the partition wall 23 on an upper part of the peripheral wall 21. The rotation preventing protrusion 63 has a proximal end 65 which is fittingly inserted through the insertion hole 27 of the peripheral wall 21, as shown in FIGS. 1 and 2.

The insertion hole 27 has an opening in the upper end of the peripheral wall 21. The opening serves as an inlet 28. In assembly, the proximal end 65 of the rotation preventing protrusion 63 is inserted through the inlet 28 of the peripheral wall 21 into the insertion hole 27. With this, the retainer body 61 is configured to be inserted into the engaging member side space 25 of the lifter body 20 together with the plunger 80.

A distance between both sides of the rotation preventing groove 96 is substantially the same as a distance between both sides of the insertion hole 27, and both distances are set to be slightly larger than a width of the rotation preventing protrusion 63, as shown in FIG. 2. More specifically, only slight clearances are defined between both sides of the rotation preventing groove 96 or the insertion hole 27 and the rotation preventing protrusion 63 respectively. Accordingly, a circumferential displacement of the retainer 60 relative to the housing 91 is reduced when the distal end 64 of the rotation preventing protrusion 63 abuts against the side of the rotation preventing groove 96, and a circumferential displacement of the lifter body 20 of the peripheral wall 21 is reduced when the side of the insertion hole 27 of the peripheral wall 21 abuts against the proximal end 65 of the rotation preventing protrusion 63. As a result, the retainer body 61 is prevented from rotation relative to the housing 91.

The working of the pump lifter 95 will now be described. The roller 70 is rotated upon rotation of the cam 94 via the cam shaft 95. In an intake stroke, the lifter body 20 is pressed by the biasing force of the biasing member 85 thereby to be moved downward, with the result that the upper end of the plunger 80 recedes from the pressure chamber. On the other hand, in an exhaust stroke, the lifter body 20 is moved upward against the biasing force of the biasing member 85 and the plunger 80 is also moved in the same manner, with the result that the upper end of the plunger 80 is moved into the pressure chamber.

While the lifter body 20 is reciprocally moved in the sliding hole 93, the proximal end 65 of the rotation preventing protrusion 63 is maintained to be fittingly extended through the insertion hole 27 of the peripheral wall 21. During this time, the distal end 64 of the rotation preventing protrusion 63 is reciprocally displaced in the rotation preventing groove 96 in the vertical direction while fittingly inserted into the rotation preventing groove 96. In this case, since the rotation preventing protrusion 63 is prevented from free circumferential movement relative to the insertion hole 27 and the rotation preventing groove 96, the lifter body 20 and the retainer 60 are configured to be prevented from rotation about the axis relative to the housing 91.

The rotation preventing protrusion 63 is formed integrally with the retainer 60 in the first embodiment. Accordingly, the number of parts can be reduced in the first embodiment than in a case where a dedicated rotation preventing member (a wedge-shaped member) is inserted into a hole formed in the peripheral wall or the like for the rotation preventing purpose, with the result that manufacturing costs can be lowered.

Furthermore, no portion protruding radially outward is provided on the outer periphery of the peripheral wall 21 of the lifter body 20. Accordingly, when the lifter body 20 is finish processed, the outer periphery of the peripheral wall 21 can continuously be ground in a through-feed manner, with the result that the working efficiency can be improved. Moreover, the circularity of the outer periphery of the peripheral wall 21 can be improved.

Furthermore, the rotation preventing protrusion 63 mounted on the retainer 60 does not affect the setting of an entire length (the vertical (sliding) dimension) of the peripheral wall 21. This can render the entire length of the peripheral wall 21 as long as possible. Consequently, the lifter body 20 can be prevented from being tilted beyond an allowable range in the sliding hole 93 so that the occurrence of cocking is reduced.

Furthermore, the peripheral wall 21 is formed with the insertion hole 27 which vertically extends and is open in the upper end of the peripheral wall 21. The distal end 64 of the rotation preventing protrusion 63 is introduced from the inlet 28 serving as the upper end opening of the insertion hole 27 and further caused to fittingly extend through the insertion hole 27. Thus, the pump lifter 10 is superior in terms of an assembling efficiency of the retainer 60. Further, the insertion hole 27 formed at a single circumferential location into the shape of a slit to be located above the partition wall 23 of the peripheral wall 21, whereby a forming range of the insertion hole 27 is reduced to requisite minimum. Accordingly, the rigidity of the peripheral wall 21 can be prevented from being lowered to a large degree.

Furthermore, since the rotation preventing protrusion 63 is formed to have a thickness differing from those of the peripheral wall 21 and the partition wall 23, the strength of the rotation preventing protrusion 63 can be adjusted to an appropriate value according to circumstances.

Figure 4:
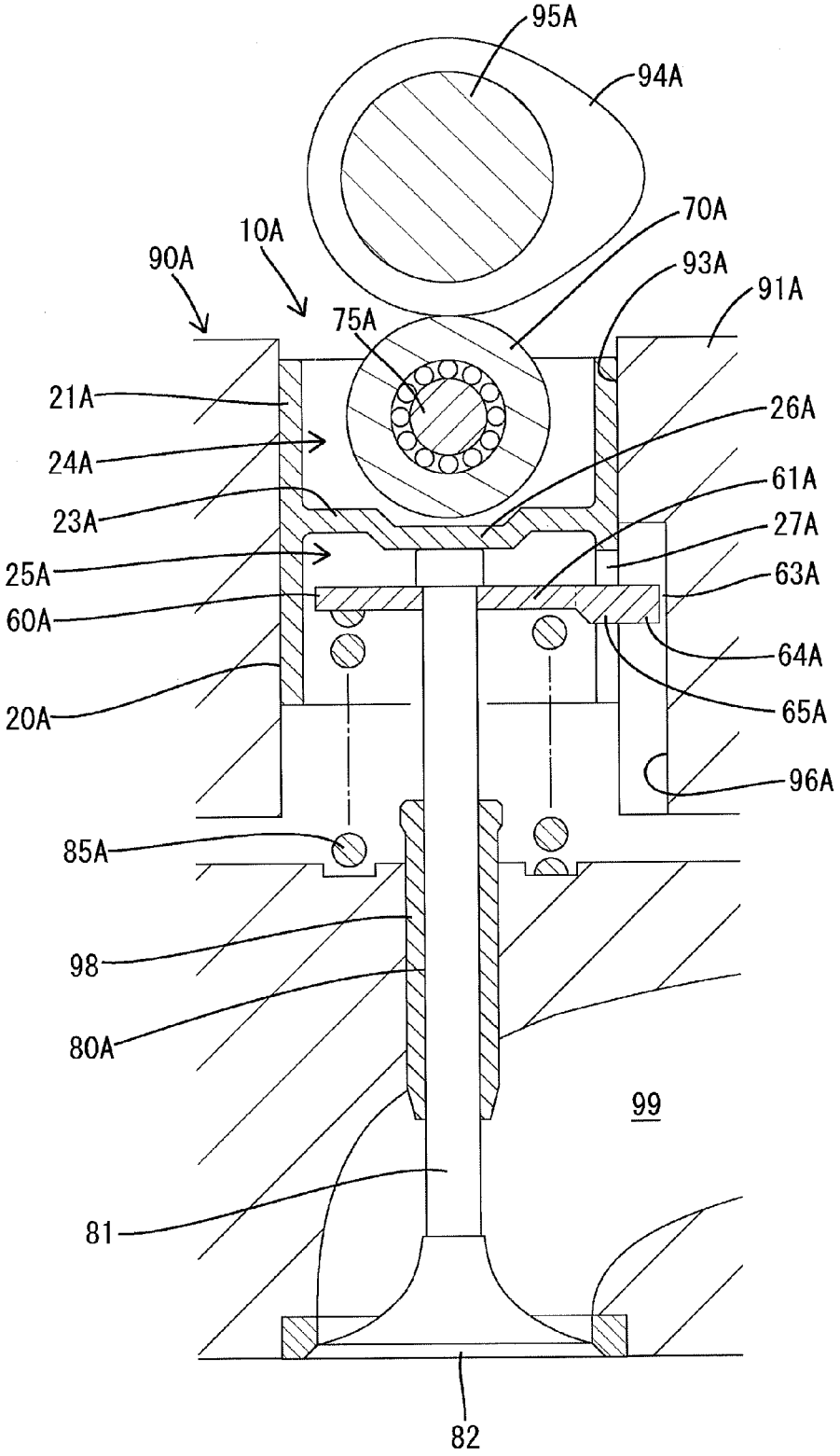
FIG. 4 is a sectional view of a valve lifter to which the lifter rotation preventing structure of a second embodiment is applied, showing the valve lifter assembled to the housing.

FIG. 4 illustrates a second embodiment. The lifter rotation preventing structure is applied to a valve lifter 10A of a valve gear.

The valve lifter 10A is disposed between the cam 94A and the valve 80A serving as the engaging member constituting the valve gear 90A and has a function of transmitting a drive force of the cam 94A to the valve 80A. The valve lifter 10A has substantially the same structure as that in the first embodiment and includes the lifter body 20A, the retainer 60A and the biasing member 85A. The roller 70A supported on the shaft 75A is housed in the cam side space 24A of the lifter body 20A. The second embodiment differs from the first embodiment in that the rotation preventing protrusion 63A of the retainer 60A is formed to have a larger thickness than the retainer body 61A. Since the rotation preventing protrusion 63A is formed to be thicker, the strength of the rotation preventing protrusion 63A is increased so that the rotation preventing protrusion 63A is guaranteed not to be deformed when interfering with the housing 91A. Further, in the second embodiment, the cam 94A mounted on the cam shaft 95A is located above the housing 91A contrary to the first embodiment. Accordingly, the valve lifter 10A is disposed in the upside-down posture with respect to the pump lifter 10 in the first embodiment.

The valve 80A includes a valve stem 81 and a valve body 82 radially bulging from a lower end of the valve stem 81. The valve body 82 faces an air inlet or air outlet 99 of the housing 91A to be capable of opening and closing the air inlet or air outlet 99. The valve stem 81 is slidably inserted into a stem guide 98 assembled to the housing 91A.

The valve stem 81 has an upper end which upwardly protrudes from the stem guide 98 and is fixed to the retainer 60A into an upright posture. The upper end of the valve stem 81 is further inserted into the engaging member side space 25A of the lifter body 20A from below. The upper end of the valve stem 81 abuts against the underside of the stepped portion 26A formed on the partition wall 23A of the lifter body 20A. The biasing member 85A which biases the lifter body 20A to the cam 94A side is interposed between the wall surface of the housing 91A and the retainer 60A.

The housing 91A has the sliding hole 93A vertically extending therethrough and the rotation preventing groove 96A which communicates with the sliding hole 93A and vertically extends. The valve lifter 10A is inserted into the sliding hole 93A of the housing 91A so as to be vertically reciprocable in the same manner as in the first embodiment. Further, the rotation preventing protrusion 63A of the retainer 60A has the proximal end 65A which fittingly extends through the insertion hole 27A of the peripheral wall 21A and the distal end 64A which is fittingly inserted into the rotation preventing groove 96A.

The lifter body 20A is moved downward against the biasing force of the biasing member 85A when the cam 94A is rotated to such an extent that the lifter body 20A is pressed downward by the roller 70A. The valve 80A is also moved downward in the same manner as the lifter body 20A, so that the air inlet or air outlet 99 is opened by the valve body 82. When the cam 94A is further rotated with the result that the pressing force from the cam 94A side is reduced, the lifter body 20A is upwardly moved by the biasing force of the biasing member 85A and the valve 80A is also moved upward in the same manner as the lifter body 20A. As a result, the air inlet or air outlet 99 is closed by the valve body 82. Thus, while the lifter body 20A is reciprocated in the sliding hole 93A, the distal end 64A of the rotation preventing protrusion 63A is moved into the insertion hole 27A of the peripheral wall 21A with the result that the lifter body 20A is guaranteed not to be rotated about the axis. Accordingly, the second embodiment can achieve the same advantageous effect as the first embodiment.

Furthermore, the rotation preventing protrusion 63A is thicker than the peripheral wall 21 and the partition wall 23 and is formed to be thicker than the retainer body 61A. This increases the strength of the rotation preventing protrusion 63A with the result that the rotation preventing protrusion 63A can be prevented from deformation in occurrence of interference with the housing 91A or the like.

Other Embodiments

Other embodiments will be described in brief.

(1) The rotation preventing protrusion in the second embodiment may be formed to be thicker by double fold.

(2) The rotation preventing protrusion of the pump lifter in the first embodiment may also be formed to be thicker than the retainer body in the same manner as in the second embodiment.

(3) The cam may be configured to be brought into direct sliding contact with the partition wall of the lifter body without interposition of the roller.

(4) The cam side space of the lifer body may be partitioned only by a pair of support walls supporting both ends of the shaft, and a recess may be defined between both support walls.

What is claimed is:

1. A lifter rotation preventing structure comprising:

a lifter body inserted into a sliding hole of a housing and reciprocated according to rotation of a cam, the lifter body having a peripheral wall slidable in the sliding hole and a partition wall partitioning an inside of the peripheral wall into a first space in which the cam is located and a second space located opposite the first space;

a retainer disposed in the second space of the lifter body and having a retainer body located inside the peripheral wall and connected to an engaging member reciprocally displaced together with the lifter body, the retainer having a rotation preventing protrusion protruding from an outer periphery of the retainer body and fittingly extending through the peripheral wall, the rotation preventing protrusion having a distal end moved into a rotation preventing groove communicating with the sliding hole of the housing thereby to prevent the lifter body from rotation; and a biasing member disposed in the second space of the lifter body and interposed between the retainer body and the housing to bias the lifter body to a side of the cam.

2. The structure according to claim 1, wherein the peripheral wall has an insertion hole extending in a sliding direction, and the insertion hole has an opening in an end of the peripheral wall, and the rotation preventing protrusion has a distal end which is introduced from the opening in the end of the peripheral wall and caused to fittingly extend through the insertion hole.

3. The structure according to claim 1, wherein the rotation preventing protrusion has a thickness differing from thicknesses of the peripheral wall and the partition wall.

4. The structure according to claim 3, wherein the rotation preventing protrusion is thicker than the peripheral wall and the partition wall.

5. The structure according to claim 1, wherein the engaging member is a plunger which is movable into and out of a pressure chamber of the housing or a valve which is capable of opening and closing an air inlet or an air outlet of the housing.

* * * * *